US011549332B2

(12) United States Patent
El Mallawany et al.

(10) Patent No.: US 11,549,332 B2
(45) Date of Patent: Jan. 10, 2023

(54) DENSITY CONSTANT FLOW DEVICE WITH FLEXIBLE TUBE

(71) Applicant: Halliburton Energy Services, Inc., Houston, TX (US)

(72) Inventors: Ibrahim El Mallawany, Dhahran (SA); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/130,578

(22) Filed: Dec. 22, 2020

(65) Prior Publication Data

US 2022/0195840 A1 Jun. 23, 2022

(51) Int. Cl.
*E21B 34/08* (2006.01)
*E21B 41/00* (2006.01)

(52) U.S. Cl.
CPC ..... *E21B 34/08* (2013.01); *E21B 41/0078* (2013.01)

(58) Field of Classification Search
CPC ..... E21B 34/08; E21B 41/0078; E21B 43/12
See application file for complete search history.

(56) References Cited

U.S. PATENT DOCUMENTS

| | | | | |
|---|---|---|---|---|
| 4,193,545 | A | 3/1980 | Havens | |
| 5,984,209 | A | 11/1999 | Weth | |
| 8,584,762 | B2 | 11/2013 | Fripp et al. | |
| 8,739,886 | B2 | 6/2014 | Fripp et al. | |
| 8,839,993 | B2 * | 9/2014 | Peirsman | B67D 1/0412 222/399 |
| 9,453,395 | B2 | 9/2016 | Fripp et al. | |
| 9,683,429 | B2 | 6/2017 | Mathiesen et al. | |
| 10,060,221 | B1 | 8/2018 | Rong et al. | |
| 10,100,622 | B2 * | 10/2018 | Gonzalez | E21B 43/12 |
| 11,119,515 | B2 * | 9/2021 | Kim | G05D 16/06 |
| 2010/0096127 | A1 | 4/2010 | Jordy | |
| 2011/0297393 | A1 | 12/2011 | Patel | |
| 2013/0048299 | A1 | 2/2013 | Fripp et al. | |
| 2016/0215598 | A1 | 7/2016 | Lopez et al. | |
| 2016/0338619 | A1 * | 11/2016 | Roxhed | A61B 5/082 |
| 2017/0254177 | A1 | 9/2017 | Woodford | |

FOREIGN PATENT DOCUMENTS

| | | | |
|---|---|---|---|
| JP | 11505008 | A | 5/1999 |
| JP | 2010285930 | A | 12/2010 |
| WO | 2010048168 | A2 | 4/2010 |
| WO | 2017144440 | A2 | 8/2017 |
| WO | 2020040896 | A1 | 2/2020 |

* cited by examiner

*Primary Examiner* — Matthew R Buck
(74) *Attorney, Agent, or Firm* — Scott Richardson; Parker Justiss, P.C.

(57) ABSTRACT

Provided, in one aspect, is a fluid flow device. The fluid flow device may include a housing having at least one fluid inlet and at least one fluid outlet. The fluid flow device according to this aspect may further include a flexible tube positioned within the housing, the flexible tube defining a fluid flow path, the flexible tube operable to have a first diameter ($d_1$) when the flexible tube encounters a first pressure from fluid within the housing and a second different diameter ($d_2$) when the flexible tube encounters a second greater pressure within the housing, the first diameter ($d_1$) and second different diameter ($d_2$) configured to provide a constant flow of the fluid out of the at least one fluid outlet.

18 Claims, 12 Drawing Sheets

DENSITY CONSTANT FLOW DEVICE WITH FLEXIBLE TUBE

BACKGROUND

In hydrocarbon production wells, it may be beneficial to regulate the flow of formation fluids from a subterranean formation into a wellbore penetrating the same. A variety of reasons or purposes may necessitate such regulation including, for example, prevention of water and/or gas coning, minimizing water and/or gas production, minimizing sand production, maximizing oil production, balancing production from various subterranean zones, and equalizing pressure among various subterranean zones, among others.

A number of devices are available for regulating the flow of formation fluids. Some of these devices may be non-discriminating for different types of formation fluids and may simply function as a "gatekeeper" for regulating access to the interior of a wellbore pipe, such as a well string. Such gatekeeper devices may be simple on/off valves or they may be metered to regulate fluid flow over a continuum of flow rates. Other types of devices for regulating the flow of formation fluids may achieve at least some degree of discrimination between different types of formation fluids. Such devices may include, for example, tubular flow restrictors, nozzle-type flow restrictors, autonomous inflow control devices, non-autonomous inflow control devices, ports, tortuous paths, and combinations thereof.

Autonomous flow control devices may be particularly advantageous in subterranean operations, since they are able to automatically regulate fluid flow without the need for operator control due to their design. In this regard, autonomous flow control devices may be designed such that they provide a greater resistance to the flow of undesired fluids (e.g., gas and/or water) than they do desired fluids (e.g., oil), particularly as the percentage of the undesired fluids increases.

BRIEF DESCRIPTION

Reference is now made to the following descriptions taken in conjunction with the accompanying drawings, in which.

DETAILED DESCRIPTION

Figure 1:
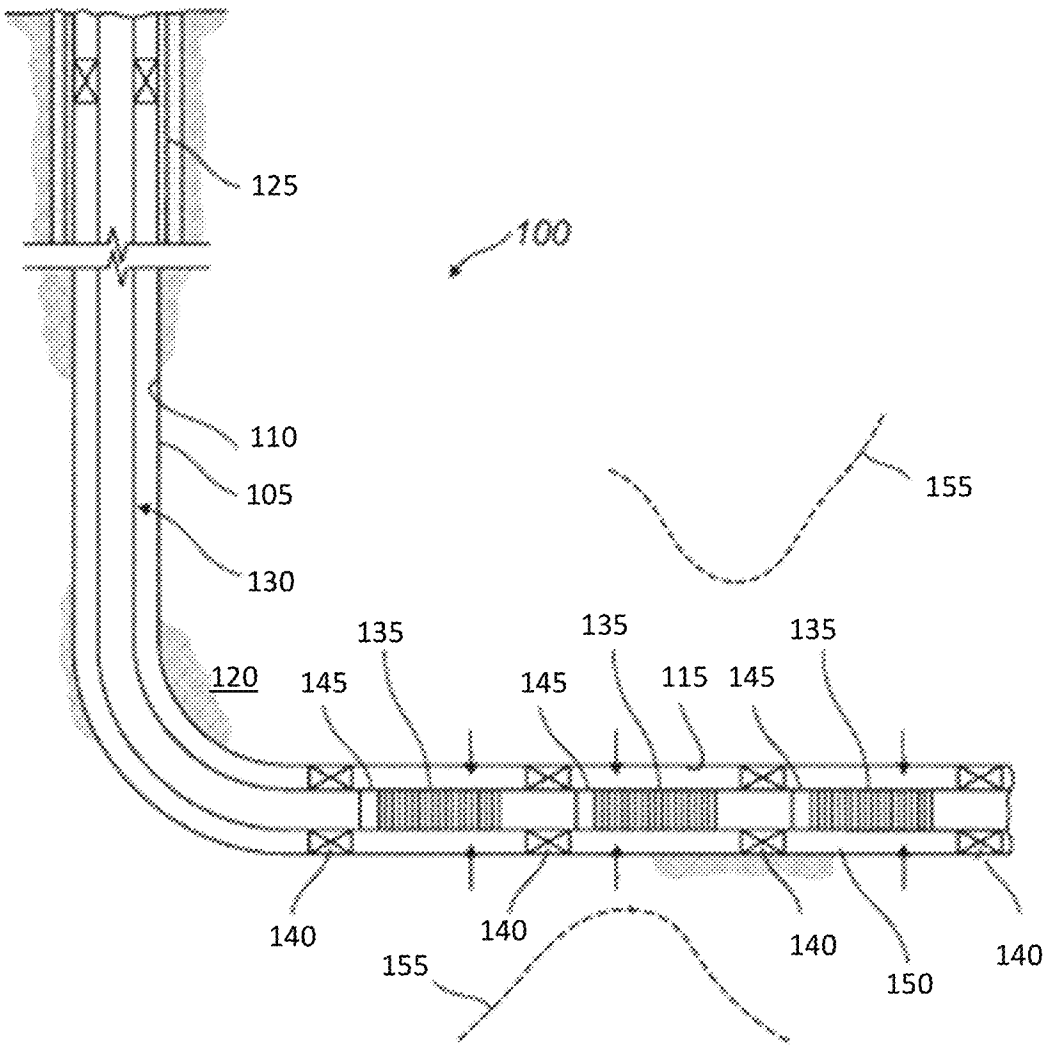
FIG. 1 is a schematic view of a well system according to one or more embodiments disclosed herein.

FIG. 1 illustrates a well system 100 according to one or more embodiments disclosed herein. The well system 100 may include a wellbore 105 that comprises a generally vertical uncased section 110 that may transition into a generally horizontal uncased section 115 extending through a subterranean formation 120. In some examples, the vertical section 110 may extend downwardly from a portion of wellbore 105 having a string of casing 125 cemented therein. A tubular string, such as production tubing 130, may be installed in or otherwise extended into wellbore 105.

In the illustrated embodiment, a plurality of well screens 135 and packers 140 may be interconnected along production tubing 130, and may include fluid flow control systems 145 positioned therewith. The packers 140 may be configured to seal off an annulus 150 defined between production tubing 130 and the walls of wellbore 105. As a result, fluids may be produced from multiple intervals of the surrounding subterranean formation 120, in some embodiments via isolated portions of annulus 150 between adjacent pairs of packers 140. In some examples, the fluid flow control systems 145 may be interconnected in the production tubing 130 and positioned between packers 140. The well screens 135 may be configured to filter fluids flowing into production tubing 130 from annulus 150. Embodiments of the flow control systems 145 may be configured to restrict or otherwise regulate the flow of fluids into the production tubing 130, based on certain physical characteristics of the fluids, such as, density. In some examples, the fluid flow control systems 145 may include embodiments of a fluid flow device which may be an autonomous flow control device that may provide a constant fluid flow, in some embodiments independent of fluid density.

Each of the fluid flow control systems 145, in one or more embodiments, may include a fluid nozzle operable to receive production fluid having a pressure, and discharge control fluid having a control pressure. Additionally, in at least one embodiment, each of the fluid flow control systems 145 could include a fluid flow device operable to receive the control fluid having the control pressure and output a constant flow of control fluid to a tubing, such as the production tubing 130.

In some embodiments, the fluid flow device may include a housing having at least one fluid inlet operable to receive the control fluid having the control pressure, and at least one fluid outlet operable to output the constant flow of the control fluid to the tubing. A flexible tube may be positioned within the housing, the flexible tube defining a fluid flow path, the flexible tube operable to have a first diameter ($d_1$) when the flexible tube encounters a lower control pressure (P2) from the fluid nozzle and a second different diameter ($d_2$) when the flexible tube encounters a second greater control pressure (P2') from the fluid nozzle, the first diameter ($d_1$) and second different diameter ($d_2$) configured to provide the constant flow of the control fluid to the tubing. A fluid flow path between the housing and the flexible tube should be designed to allow the fluid to stay in the laminar flow regime while within the operating window.

In some other embodiments, the fluid flow device may include a housing having at least one fluid inlet and at least one fluid outlet, and a sleeve positioned within the housing. Furthermore, a fluid flow member may be positioned within the sleeve, wherein at least one of an interior surface of the sleeve or an exterior surface of the fluid flow member has a non-linear fluid flow path therein. According to this embodiment, the sleeve and fluid flow member are movable with respect to one another to define a first overlap distance of the non-linear fluid flow path and a first fluid flow path length when the housing encounters a first fluid flow pressure, and a second greater overlap of the non-linear fluid flow path and a second greater fluid flow path length when the housing encounters a second greater fluid flow pressure, the first fluid flow path length and the second greater fluid flow path length configured to provide a constant flow of the fluid out of the at least one fluid outlet.

According to the above embodiments, the Hagen Poiseuille equation is being used, and the inputs thereto are being adjusted, to accommodate the change in pressure. The Hagen Poiseuille equation states:

$$\Delta p = \frac{8\mu LQ}{\pi R^4} = \frac{8\pi\mu LQ}{A^2}$$

In the first embodiment above, wherein the diameters of the flexible tube changes, the area ($A^2$) in the Hagen Poiseuille equation is being adjusted to accommodate the change in pressures (Δp). In the second embodiment above, wherein the length of the fluid flow paths change, the length (L) in the Hagen Poiseuille equation is being adjusted to accommodate the change in pressures (Δp).

Each flow control system 145, regardless of the embodiments for the fluid flow device described above, may also include an inflow control device having a production fluid inlet operable to receive the wellbore fluid having a pressure (P3), a control inlet operable to receive the fluid having a control pressure (P2) from the nozzle, and a production fluid outlet operable to selectively pass the production fluid to the tubing, the inflow control device configured to open or close the production fluid outlet based upon a pressure differential value between the control pressure and the pressure of the wellbore fluid.

Embodiments of the fluid flow device may provide constant flow of fluid, which is not affected by changes in a density of the fluid. Other embodiments may provide a constant flow of fluid when the first pressure (P2) and the second greater pressure (P2') remain within a range of about 20 psi (137.895 kPa) to about 200 psi (1378.95 kPa). A fluid flow path for the fluid flow device should be designed to allow the fluid to stay in the laminar flow regime while within the operating window, for example such that the density of the fluid will not play a role in the pressure drop.

Embodiments of fluid flow control systems 145 may be used, in some examples, to control the flow of fluids into the production tubing 130 from each zone of subterranean formation 120, for example in one embodiment to prevent water coning 155 in subterranean formations 120. The fluid flow control systems 145 may also be used to regulate flow within the wellbore, including balancing production from (or injection into) multiple zones, minimizing production or injection of undesired fluids, maximizing production or injection of desired fluids, and other applications.

Figure 2:
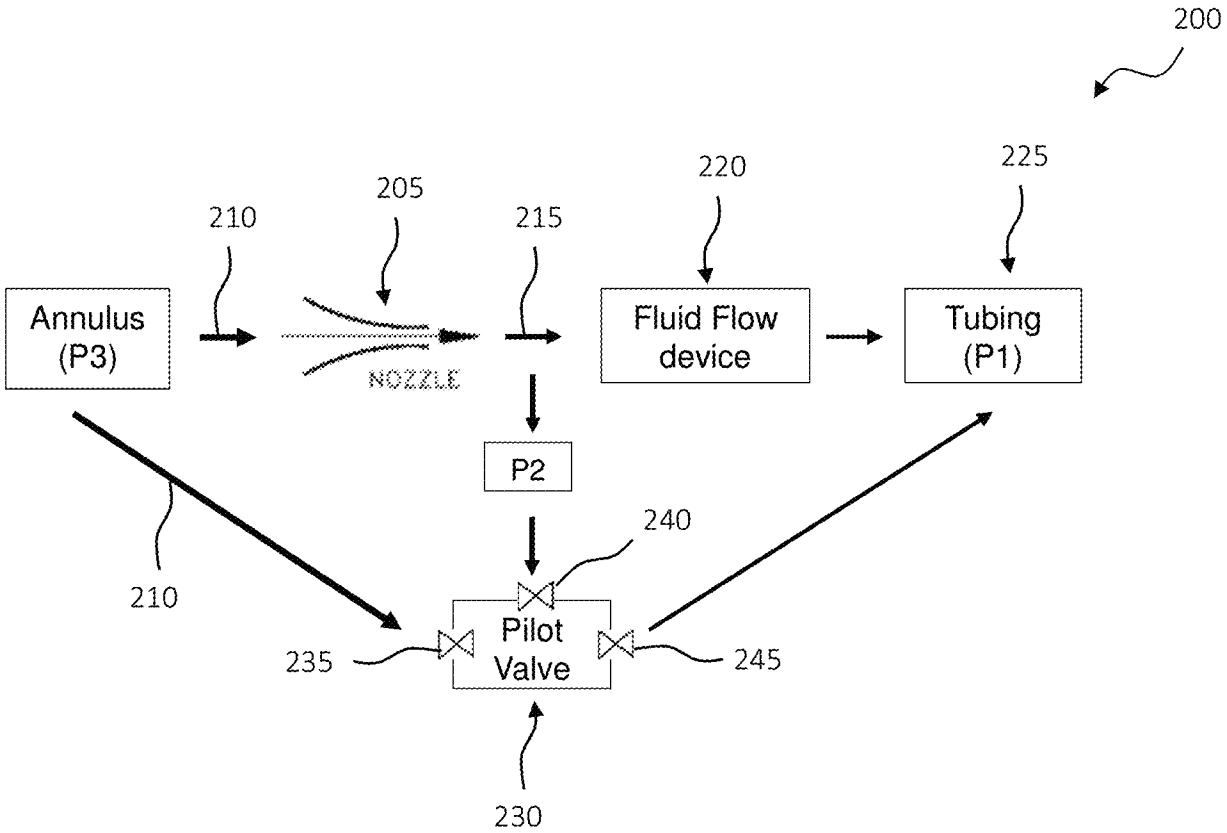
FIG. 2 illustrates a fluid flow control system designed and manufactured according to one or more embodiments of the disclosure.

FIG. 2 illustrates a fluid flow control system 200 designed, manufactured and operated according to one or more embodiments of the disclosure. The fluid flow control system 200, in one embodiment, may include a fluid nozzle 205 operable to receive production fluid 210 (e.g., from an annulus) having a pressure (P3), and discharge control fluid 215 having a control pressure (P2). A fluid flow device 220 may be operable to receive the control fluid 215 having the control pressure (P2) and output a constant flow of control fluid to a tubing 225. In some embodiments, the fluid flow device 220 may include a housing having at least one fluid inlet operable to receive the control fluid 215 having the control pressure (P2) and at least one fluid outlet operable to output the constant flow of the control fluid to the tubing 225. Various different embodiments of a fluid flow device 220 designed, manufactured and operated in accordance with the present disclosure are discussed below The fluid flow control system 200 may additionally include an inflow control device 230, which in some embodiments may be a pilot valve. The inflow control device 230 may include a production fluid inlet 235 operable to receive the production fluid from the annulus 210 having the pressure (P3), a control inlet 240 operable to receive the control fluid 215 having the control pressure (P2) from the fluid nozzle 205, and a production fluid outlet 245 operable to selectively pass the production fluid to the tubing 225. The inflow control device 230, in this embodiment, is thus configured to open or close the production fluid outlet 245 based upon a pressure differential value (P3–P2).

In some embodiments, the constant flow of fluid through the fluid flow device 220 may be density independent such that the constant flow of fluids may not be affected by changes in a density of the fluid. And in some examples, the flow of the fluid through the fluid flow device 220 may remain constant when the control pressure (P2) and the second greater control pressure (P2') remain within a range of 20 psi (137.895 kPa) to 200 psi (1378.95 kPa).

One example of a system in which the fluid flow control system 200 may be placed is provided herein. In this example, oil viscosity may be similar to or equal to water. The fluid flow device 220 in this example may produce a constant flow of 0.5 gallons per minute (GPM) (31.55 cubic centimeters per second ($cm^3/s$)) for water viscosity (and assuming the worst case scenario that the oil viscosity is equal to the water viscosity), regardless of fluid density (oil or water) and for pressures ranging from 20 psi (137.895 kPa) to 200 psi (1378.95 kPa). With a constant flow through the fluid nozzle 205, the pressure differential, or pressure drop, across the fluid nozzle 205 (P3–P2) may be predictable when fluid density is known. For example, when the fluid nozzle 205 has an orifice of 0.07 in (1.778 mm), the pressure differential across the fluid nozzle 205 (P3–P2) may be about 50 psi (344.738 kPa) for water having a fluid density is of about 65.55 $lb/ft^3$ (1050.01 $kg/m^3$), and the pressure differential across the fluid nozzle 205 (P3–P2) may be about 36 psi (248.211 kPa) for oil having a fluid density of about 47.2 $lb/ft^3$ (756.017 $kg/m^3$). Similar pressure differentials may occur for a range of draw down pressures, such as between about 70 psi (482.633 kPa) to about 230 psi (1585.79 kPa).

In this example, the inflow control device 230, e.g., a pilot valve in one example, may be designed to open when the pressure differential (P3–P2) is less than 42 psi (289.58 kPa), such as when oil is the flowing fluid, and close if the pressure differential (P3–P2) is greater than 42 psi (289.58 kPa), such as when water is the flowing fluid. Moreover, even if the viscosity of the oil increases in relation to the viscosity of the water, the flow of fluid through fluid flow device 220 may be less than 0.5 GPM (31.55 $cm^3/s$) when the production fluid is oil. Accordingly, the pressure differential across the fluid nozzle 205 (P3–P2) will be even less than 36 psi (248.211 kPa), which means that the inflow control device 230 would appropriately be open. Accordingly, the fluid flow control system 200 is not affected by changes in the viscosity of the oil in relation to the water.

Figure 3B:
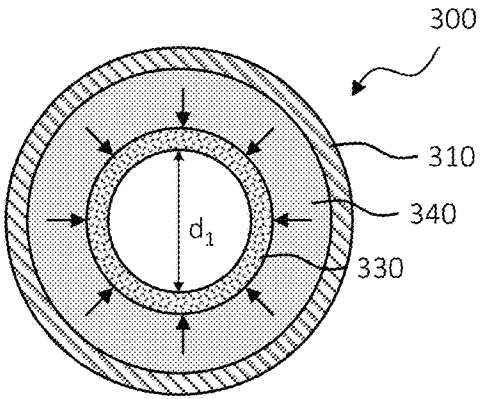
FIGS. 3A through 3D illustrate a fluid flow device designed and manufactured according to one or more embodiments of the disclosure.
Figure 3A:
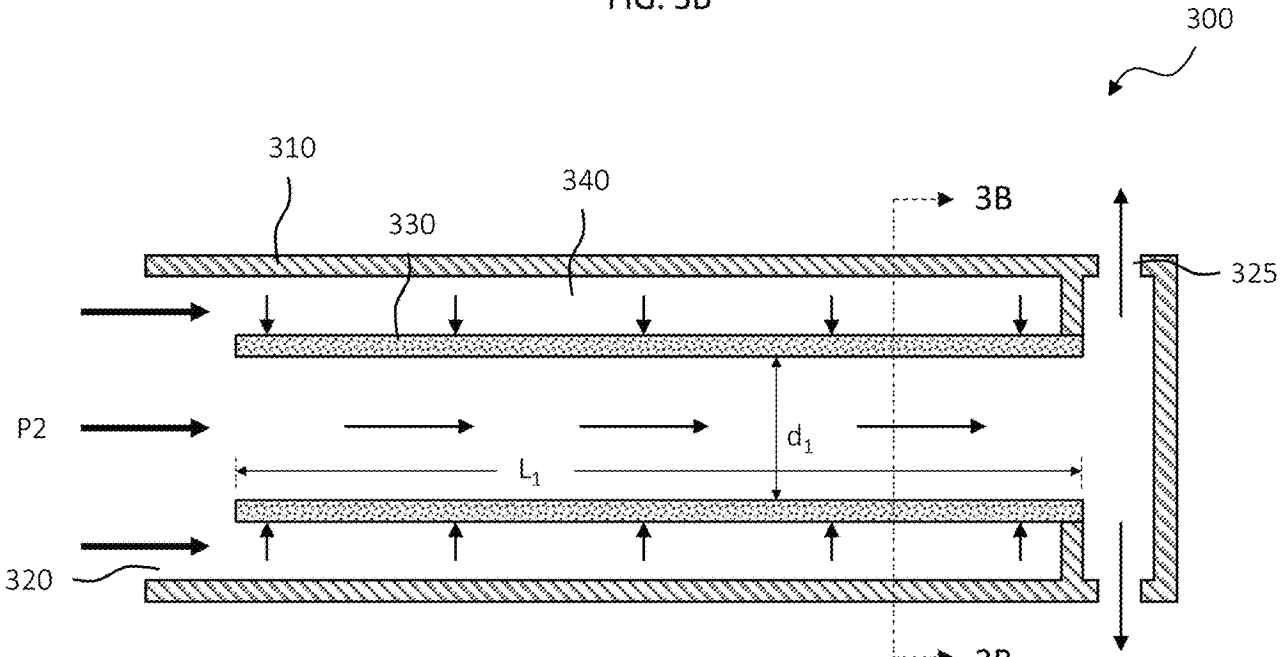
Figure 3D:
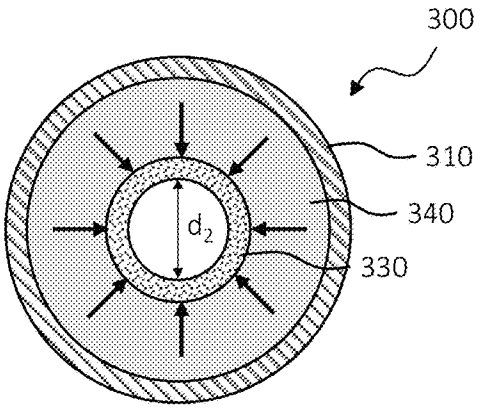
Figure 3C:
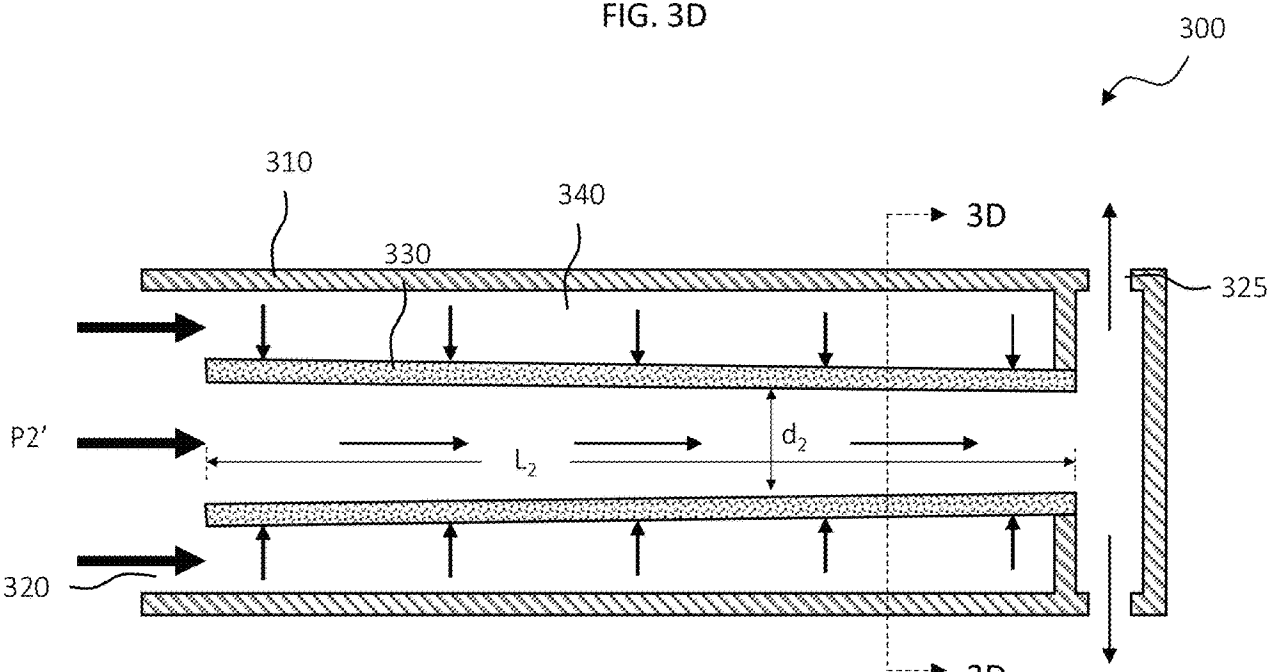

Referring now to FIGS. 3A through 3D, there is shown one embodiment of a fluid flow device 300 designed, manufactured and operated according to one or more embodiments of the disclosure. FIGS. 3A and 3B illustrate the fluid flow device 300 when being subjected to a lower fluid flow pressure (P2), whereas FIGS. 3C and 3D illustrate the fluid flow device 300 when being subjected to a second greater fluid flow pressure (P2'). Moreover, FIG. 3B illustrates a cross-sectional view of the fluid flow device 300 taken through the line 3B-3B in FIG. 3A, and FIG. 3D illustrates a cross-sectional view of the fluid flow device 300 taken through the line 3D-3D in FIG. 3C.

The fluid flow device 300, in at least one embodiment, provides a constant flow there through. For example, in one or more embodiments, the constant flow of the fluid flow device 300 is not affected by changes in the density of the fluid. Moreover, in at least one embodiment, the flow of the fluid out of the fluid flow device 300 remains constant when the pressure it is being subjected to (e.g., the first pressure (P2) and the second greater pressure (P2')) remains within a range of 20 psi (137.895 kPa) to 200 psi (1378.95 kPa). All of the above may be achieved, particularly when the fluid flow device 300 has a laminar fluid flow path there through.

The fluid flow device 300 in the embodiment of FIGS. 3A through 3D includes a housing 310. The housing 310, in at least one embodiment, includes at least one fluid inlet 320 and at least one fluid outlet 325. The number and size of the at least one fluid inlet 320 and at least one fluid outlet 325 may vary greatly and remain within the scope of the disclosure. Specifically, the number and size of the at least one fluid inlet 320 and at least one fluid outlet 325 may be designed for a given constant flow rate of the fluid flow device 300.

The fluid flow device 300, in at least one embodiment, additionally includes a flexible tube 330 positioned within the housing 310. In at least one embodiment, the flexible tube 330 defines a fluid flow path (e.g., illustrated with the arrows) through the fluid flow device 300. In at least one embodiment, the flexible tube 330 is operable to have a first diameter ($d_1$) when the flexible tube 330 encounters a first pressure (P2) from fluid within the housing 310, and a second different diameter ($d_2$) when the flexible tube encounters a second greater pressure (P2') within the housing 310. In accordance with one embodiment of the disclosure, the first diameter ($d_1$) and second different diameter ($d_2$) are configured to provide a constant flow of the fluid out of the at least one fluid outlet 325.

In the illustrated embodiment of FIGS. 3A through 3D, an interior of the flexible tube 330 provides the fluid flow path. Further to this embodiment, an annulus 340 between the flexible tube 330 and the housing 310 is capped, for example proximate an end of the flexible tube 330 and near the at least one fluid outlet 325. Accordingly, the flexible tube 330 of this embodiment has the first diameter ($d_1$) when the annulus 340 is subjected to the first pressure (P2) and a second lesser diameter ($d_2$) when the annulus 340 is subjected to the second greater pressure (P2'). The first diameter ($d_1$) and second lesser diameter ($d_2$), in one embodiment, are due to the increase in fluid velocity within the flexible tubing 330, and thus the pressure drop on an inside of the flexible tubing 330 in relation to an outside of the flexible tubing 330. In the illustrated embodiment of FIGS. 3A through 3D, the flexible tube 330 is operable to have a first length ($L_1$) when it has the first diameter ($d_1$), and is operable to be radially compressed and have a second greater length ($L_2$) when the flexible tube 330 has the second lesser diameter ($d_2$).

Figure 4B:
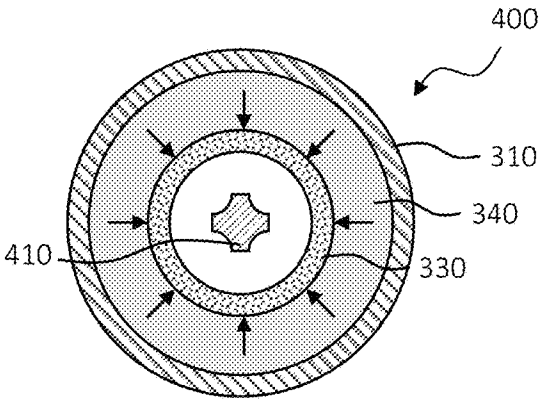
FIGS. 4A through 4D illustrate a fluid flow device designed and manufactured according to one or more other embodiments of the disclosure.
Figure 4A:
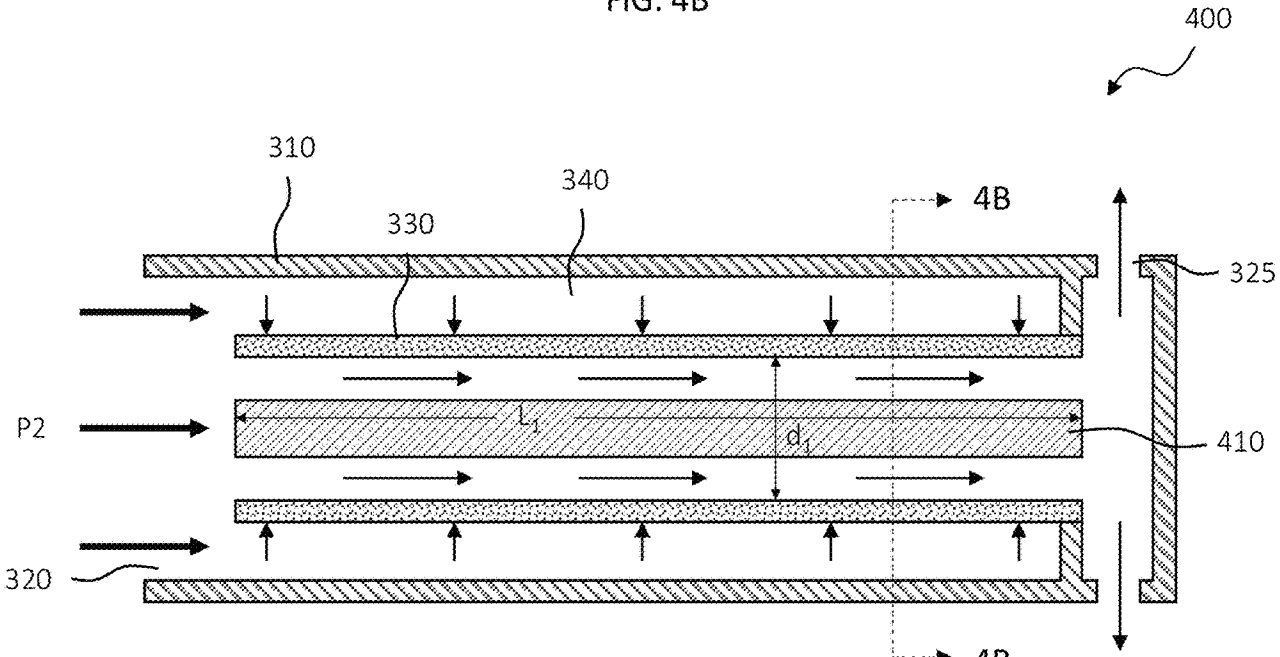
Figure 4D:
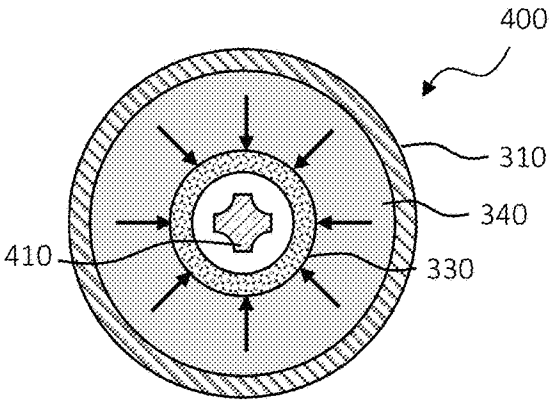
Figure 4C:
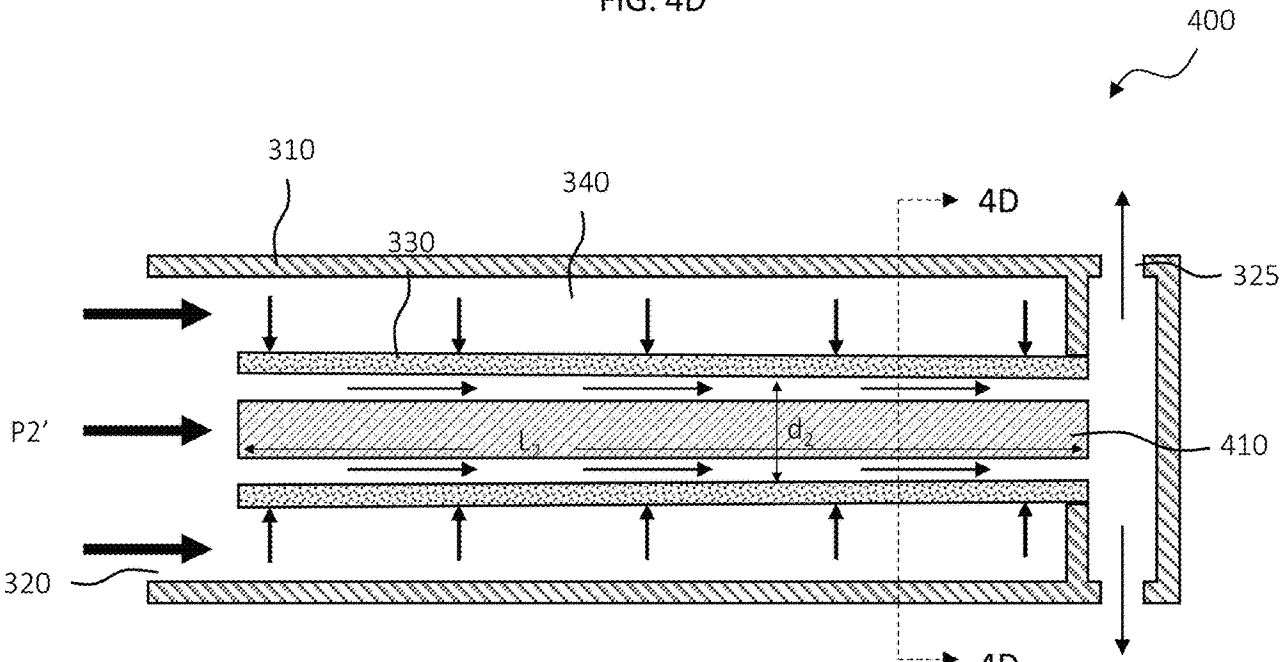

Referring now to FIGS. 4A through 4D, there is shown an alternative embodiment of a fluid flow device 400 designed, manufactured and operated according to one or more embodiments of the disclosure. FIGS. 4A and 4B illustrate the fluid flow device 400 when being subjected to a lower fluid flow pressure (P2), whereas FIGS. 4C and 4D illustrate the fluid flow device 400 when being subjected to a second greater fluid flow pressure (P2'). Moreover, FIG. 4B illustrates a cross-sectional view of the fluid flow device 400 taken through the line 4B-4B in FIG. 4A, and FIG. 4D illustrates a cross-sectional view of the fluid flow device 400 taken through the line 4D-4D in FIG. 4C.

The fluid flow device 400 of FIGS. 4A through 4D is similar in many respects to the fluid flow device 300 of FIGS. 3A through 3D. Accordingly, like reference numbers have been used to illustrate similar, if not identical, features. The fluid flow device 400 of FIGS. 4A through 4D differs, for the most part, from the fluid flow device 300 of FIGS. 3A through 3D, in that the fluid flow device 400 additionally includes a rigid member 410 positioned within the flexible tube 330. In accordance with one or more embodiments, the rigid member 410 is operable to prevent a collapse of the flexible tube 330 when the annulus 340 is subjected to the second greater pressure (P2'). The rigid member 410, in at least one embodiment, is a solid rigid member. Nevertheless, other embodiments may exist wherein the rigid member 410 is a tubular rigid member.

Figure 5B:
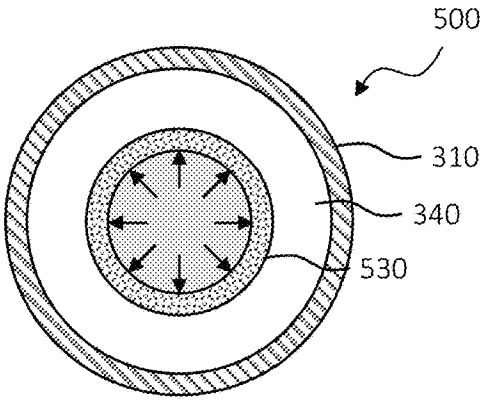
FIGS. 5A through 5D illustrate a fluid flow device designed and manufactured according to one or more alternate embodiments of the disclosure.
Figure 5A:
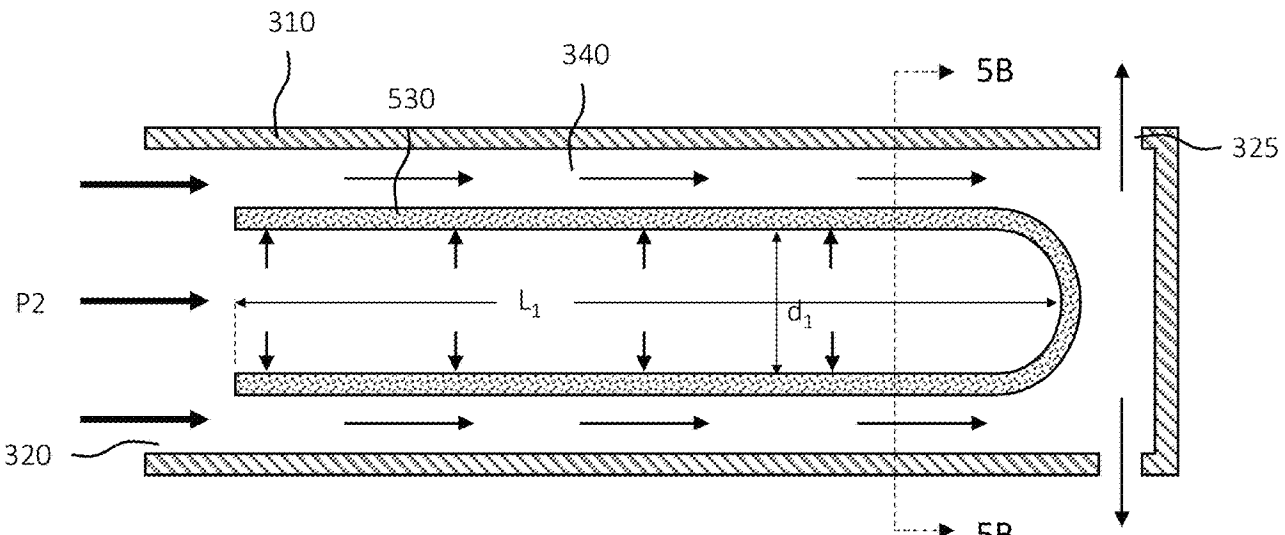
Figure 5D:
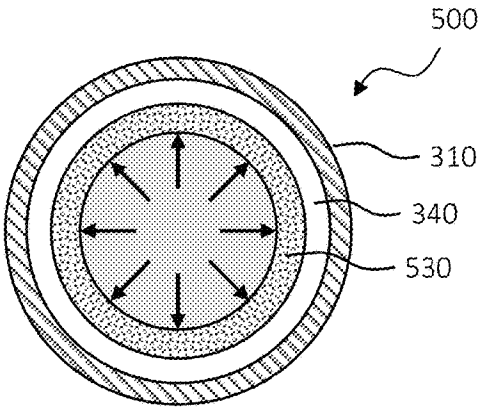
Figure 5C:
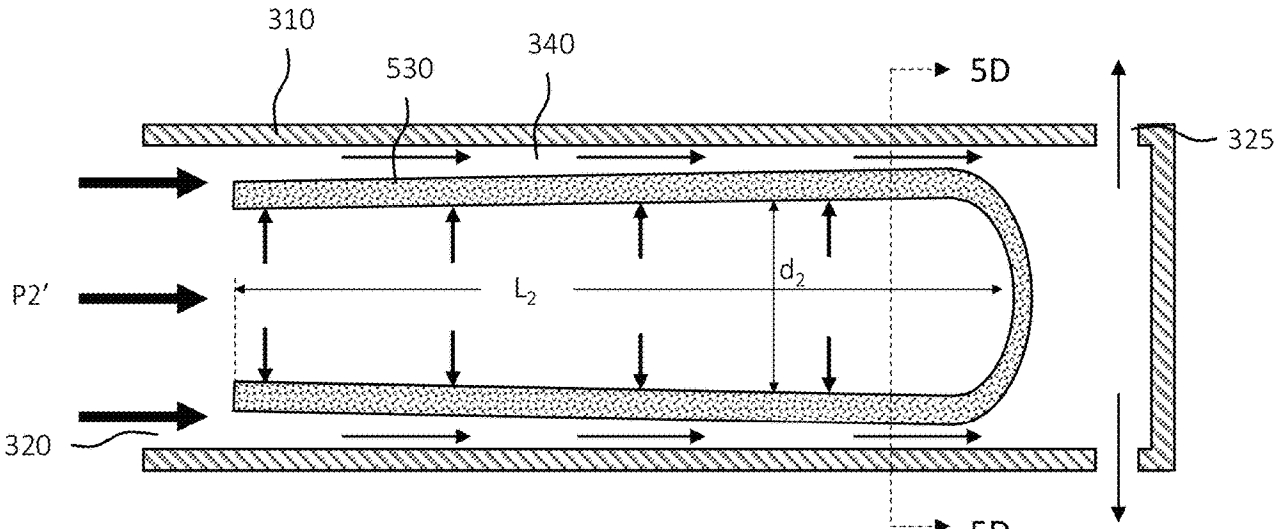

Referring now to FIGS. 5A through 5D, there is shown an alternative embodiment of a fluid flow device 500 designed, manufactured and operated according to one or more embodiments of the disclosure. FIGS. 5A and 5B illustrate the fluid flow device 500 when being subjected to a lower fluid flow pressure (P2), whereas FIGS. 5C and 5D illustrate the fluid flow device 500 when being subjected to a second greater fluid flow pressure (P2'). Moreover, FIG. 5B illustrates a cross-sectional view of the fluid flow device 500 taken through the line 5B-5B in FIG. 5A, and FIG. 5D illustrates a cross-sectional view of the fluid flow device 500 taken through the line 5D-5D in FIG. 5C.

The fluid flow device 500 of FIGS. 5A through 5D is similar in many respects to the fluid flow device 300 of FIGS. 3A through 3D. Accordingly, like reference numbers have been used to illustrate similar, if not identical features. The fluid flow device 500 of FIGS. 5A through 5D differs, for the most part, from the fluid flow device 300 of FIGS. 3A through 3D, in that its flexible tube 530 is capped proximate the at least one fluid outlet 325, and the housing 310 is not capped. In accordance with this embodiment, the annulus 340 between the capped flexible tube 530 and the housing 310 provides the fluid flow path. Thus, in contrast to that shown in FIGS. 3A through 3D, the flexible tube 530 of FIGS. 5A through 5D has the first diameter ($d_1$) when an interior of the flexible tube 530 is subjected to the first pressure (P2) from the fluid, and a second greater diameter ($d_2$) when the interior of the flexible tube 530 is subjected to the second greater pressure (P2') from the fluid. The first diameter ($d_1$) and second lesser greater ($d_2$), in one embodiment, are due to the increase in fluid velocity within the annulus 340, and thus the pressure drop on an outside of the flexible tubing 330 in relation to an inside of the flexible tubing 330. Further to this embodiment, the flexible tube 530 is operable to have the first length ($L_1$) when it has the first diameter ($d_1$), and is operable to be radially expanded and have a second lesser length ($L_2$) when the flexible tube 530 has the second greater diameter ($d_2$).

Figure 6A:
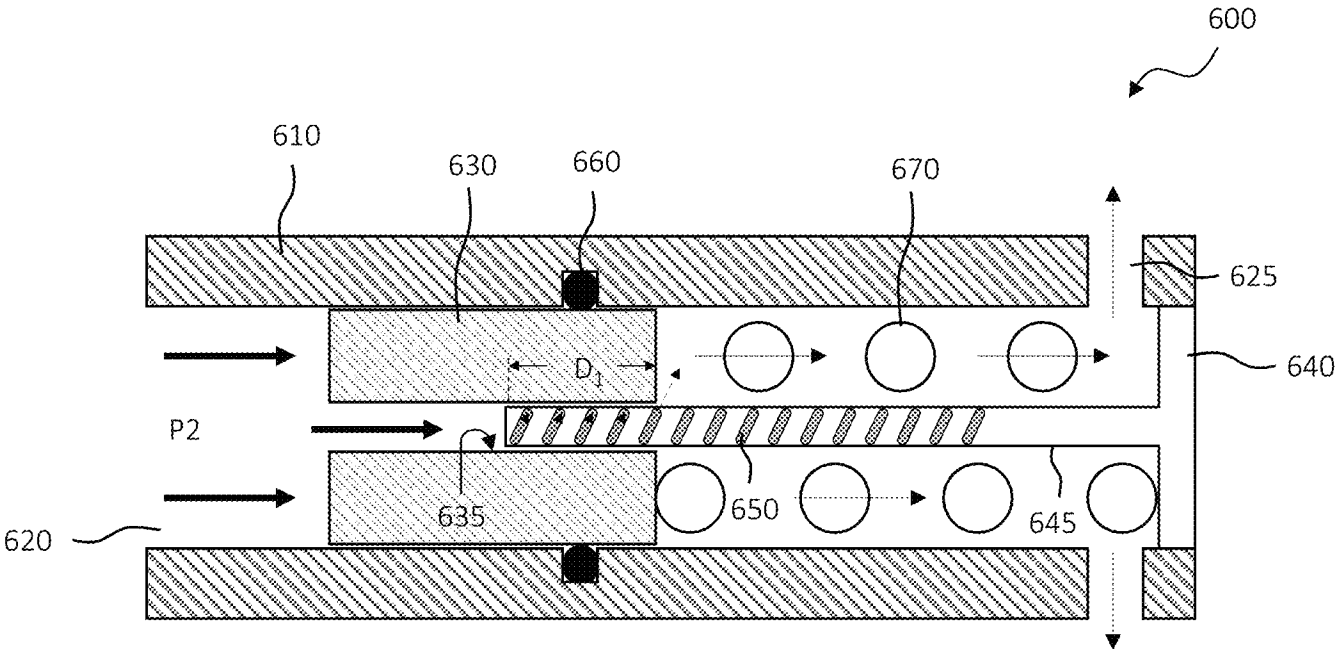
FIGS. 6A and 6B illustrate a fluid flow device designed and manufactured according to one or more other embodiments of the disclosure.
Figure 6B:
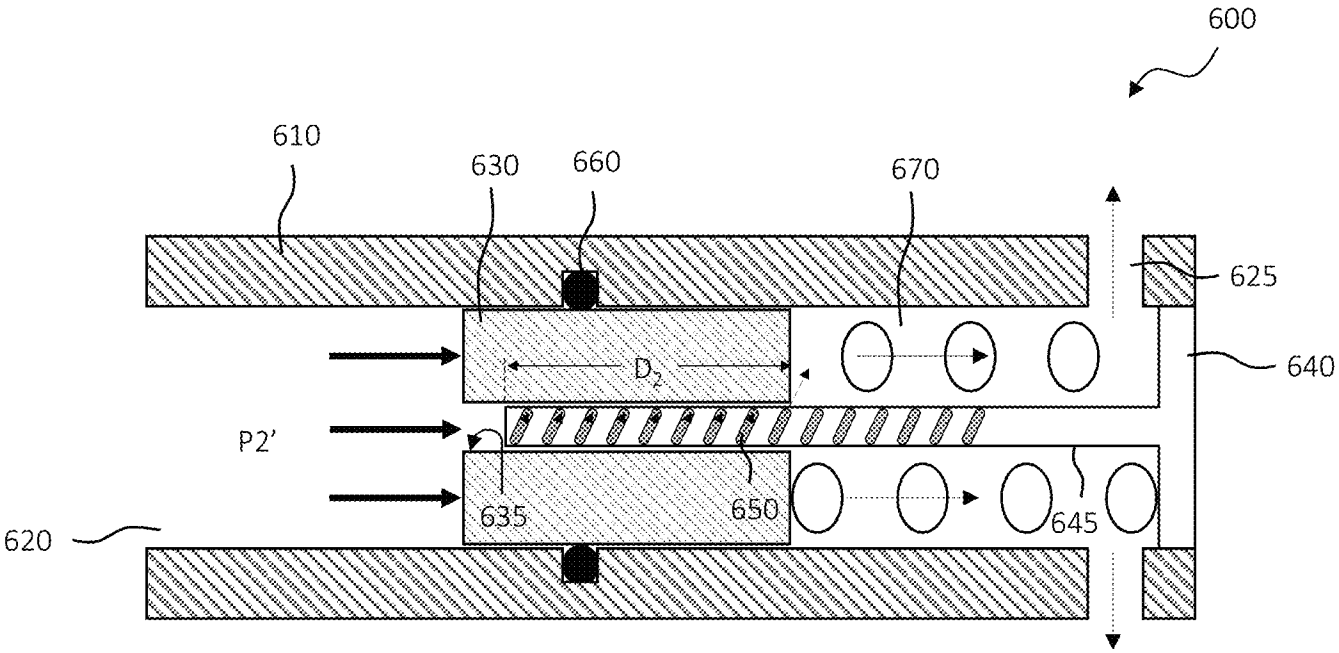

Referring now to FIGS. 6A and 6B, there is shown an alternative embodiment of a fluid flow device 600 designed, manufactured and operated according to one or more embodiments of the disclosure. FIG. 6A illustrates the fluid flow device 600 when being subjected to a lower fluid flow pressure (P2), whereas FIG. 6B illustrates the fluid flow device 600 when being subjected to a second greater fluid flow pressure (P2'). The fluid flow device 600, in at least one embodiment, includes a housing 610. The housing 610, in at least one embodiment, includes at least one fluid inlet 620 and at least one fluid outlet 625. The number and size of the at least one fluid inlet 620 and at least one fluid outlet 625 may vary greatly and remain within the scope of the disclosure. Specifically, the number and size of the at least one fluid inlet 620 and at least one fluid outlet 625 may be designed for a given constant flow rate of the fluid flow device 600.

The fluid flow device 600, in the illustrated embodiment, further includes a sleeve 630 positioned within the housing 610, as well as a fluid flow member 640 positioned within the sleeve 630. In accordance with the disclosure, at least one of an interior surface 635 of the sleeve 630 or an exterior surface 645 of the fluid flow member 640 has a non-linear fluid flow path 650 therein. For example, in the embodiment of FIGS. 6A and 6B, the non-linear fluid flow path 650 is located within the exterior surface 645 of the fluid flow member 640. Further to this embodiment, the non-linear fluid flow path 650 is a helical fluid flow path. Nevertheless, other non-linear fluid flow paths are within the scope of the disclosure. While the embodiment of FIGS. 6A and 6B are described with regard to a non-linear fluid flow path, certain embodiments may exist wherein a liner fluid flow path is used to control the flow. The linear fluid flow path, however, might require a greater relative movement of the sleeve 630 and the fluid flow member 640 to achieve the constant flow.

In accordance with one or more embodiments of the disclosure, the sleeve 630 and fluid flow member 640 are movable with respect to one another. Accordingly, in the embodiment illustrated, the sleeve 630 and the fluid flow member 640 define a first overlap distance ($D_1$) of the non-linear fluid flow path 650 and a first fluid flow path length when the housing 610 encounters a first fluid flow pressure (P1), and a second greater overlap distance ($D_2$) of the non-linear fluid flow path 650 and a second greater fluid flow path length when the housing 610 encounters a second greater fluid flow pressure (P2').

The first fluid flow path length, in the illustrated embodiment of FIG. 6A, would equal approximately four revolutions around the fluid flow member 640. The second fluid flow path length, in the illustrated embodiment of FIG. 6B, would equal approximately eight revolutions around the fluid flow member 640. Those skilled in the art appreciate that the fluid flow path length is not limited to the four and eight revolutions around the fluid flow member 640 as discussed above, and that these numbers are only being used for discussion purposes. The idea is, however, that the fluid flow path length increases as the fluid flow device 600 is subjected to higher pressures, and that the increase in fluid flow path length causes the fluid flow device 600 to have a constant flow therefrom. Thus, in this embodiment, the first fluid flow path length and the second greater fluid flow path length are configured to provide a constant flow of the fluid out of the at least one fluid outlet 625.

In the embodiment illustrate in FIGS. 6A and 6B, the fluid flow member 640 is fixed relative to the housing 610, and the sleeve 630 is movable with respect to the housing 610 and the fluid flow member 640. To accommodate the sliding sleeve 630, the fluid flow device 600 may have one or more seals 660 positioned between the housing 610 and the sliding sleeve 630. In the illustrated embodiment of FIGS. 6A and 6B, the fluid flow member 640 is a piston. Further to this embodiment, a spring member 670 may be positioned between the piston and the movable sleeve, for example to provide the requisite resistance against movement of the sliding sleeve 630.

Figure 7A:
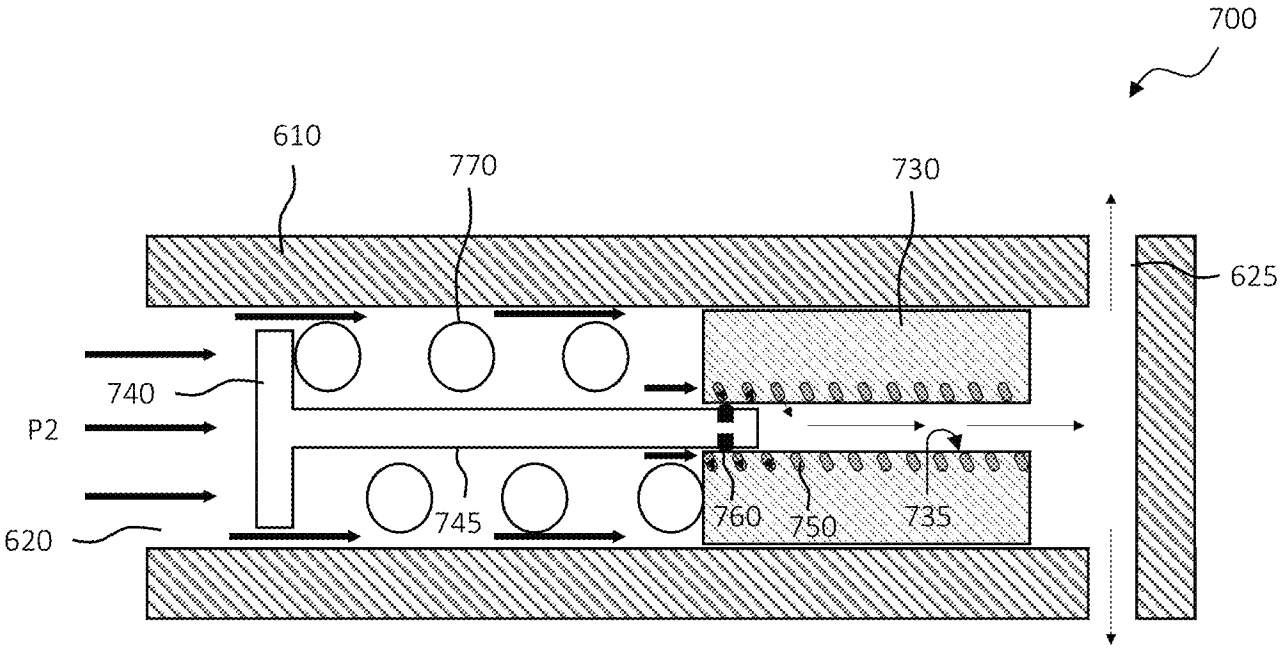
FIGS. 7A and 7B illustrate an alternative embodiment of a fluid flow device designed, manufactured and operated according to one or more embodiments of the disclosure.
Figure 7B:
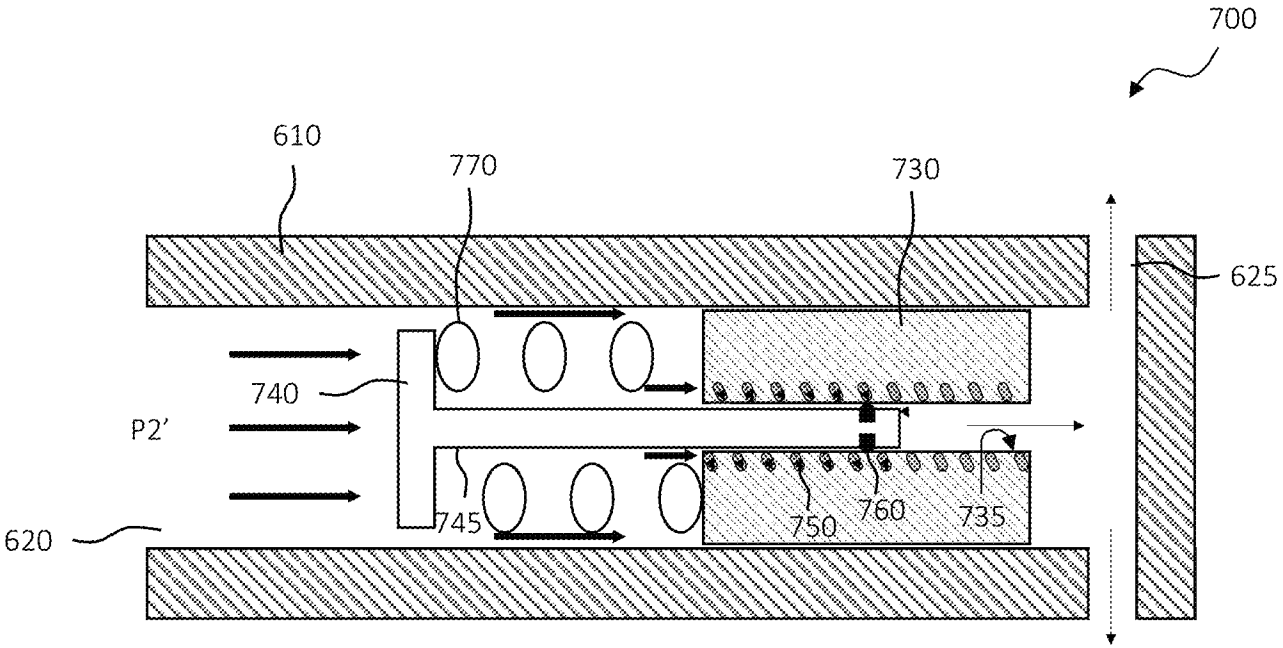

Referring now to FIGS. 7A and 7B, there is shown an alternative embodiment of a fluid flow device 700 designed, manufactured and operated according to one or more embodiments of the disclosure. FIG. 7A illustrates the fluid flow device 700 when being subjected to a lower fluid flow pressure (P2), whereas FIG. 7B illustrates the fluid flow device 700 when being subjected to a second greater fluid flow pressure (P2'). The fluid flow device 700 of FIGS. 7A and 7B is similar in many respects to the fluid flow device 600 of FIGS. 6A and 6B. Accordingly, like reference numbers have been used to illustrate similar, if not identical features. The fluid flow device 700 of FIGS. 7A and 7B differs, for the most part, from the fluid flow device 600 of FIGS. 6A and 6B, in that its sleeve 730 is fixed relative to the housing 610, and the fluid flow member 740 is movable with respect to the housing 610 and the sleeve 730. To accommodate the sliding fluid flow member 740, the fluid flow device 600 may have one or more seals 760 positioned between the housing 610 and the sliding fluid flow member 740.

In the illustrated embodiment of FIGS. 7A and 7B, the fluid flow member 740 is a piston. Further to this embodiment, a spring member 770 may be positioned between the piston and the movable sleeve, for example to provide the requisite resistance against movement of the fluid flow member 740.

Further to the embodiment of FIGS. 7A and 7B, the interior surface 735 of the sleeve 730 includes the non-linear fluid flow path 750 therein. This is in contrast to that shown in FIGS. 6A and 6B. Furthermore, the non-linear fluid flow path 750 in the interior surface 735 of the sleeve 730 is a helical fluid flow path. The first fluid flow path length, in the illustrated embodiment of FIG. 7A, would equal approximately three revolutions around the fluid flow member 740. The second fluid flow path length, in the illustrated embodiment of FIG. 7B, would equal approximately seven revolutions around the fluid flow member 740. Those skilled in the art appreciate that the fluid flow path length is not limited to the three and seven revolutions around the fluid flow member 740 as discussed above, and that these numbers are only being used for discussion purposes. The idea is, however, that the fluid flow path length increases as the fluid flow device 700 is subjected to higher pressures, and that the increase in fluid flow path length causes the fluid flow device 700 to have a constant flow therefrom. Thus, in this embodiment, the first fluid flow path length and the second greater fluid flow path length are configured to provide a constant flow of the fluid out of the at least one fluid outlet 625. While the embodiment of FIGS. 7A and 7B are described with regard to a non-linear fluid flow path, certain embodiments may exist wherein a liner fluid flow path is used to control the flow. The linear fluid flow path, however, might require a greater relative movement of the sleeve 730 and the fluid flow member 740 to achieve the constant flow.

Aspects disclosed herein include:

A. A fluid flow device, the fluid flow device including: 1) a housing having at least one fluid inlet and at least one fluid outlet; and 2) a flexible tube positioned within the housing, the flexible tube defining a fluid flow path, the flexible tube operable to have a first diameter ($d_1$) when the flexible tube encounters a first pressure from fluid within the housing and a second different diameter ($d_2$) when the flexible tube encounters a second greater pressure within the housing, the first diameter ($d_1$) and second different diameter ($d_2$) configured to provide a constant flow of the fluid out of the at least one fluid outlet.

B. A fluid flow control system, the fluid flow control system including: 1) a fluid nozzle operable to receive production fluid having a pressure (P3) and discharge control fluid having a control pressure (P2); 2) a fluid flow device operable to receive the control fluid having the control pressure (P2) and output a constant flow of control fluid to a tubing, the fluid flow device including; a) a housing having at least one fluid inlet operable to receive the control fluid having the control pressure (P2) and at least one fluid outlet operable to output the constant flow of the control fluid to the tubing; and b) a flexible tube positioned within the housing, the flexible tube defining a fluid flow path, the flexible tube operable to have a first diameter when the flexible tube encounters a lower control pressure (P2) from the fluid nozzle and a second different diameter when the flexible tube encounters a second greater control pressure (P2) from the fluid nozzle, the first diameter and second different diameter configured to provide the constant flow of the control fluid to the tubing; 3) an inflow control device having a production fluid inlet operable to receive the wellbore fluid having the pressure (P3), a control inlet operable to receive the fluid having the control pressure (P2) from the nozzle, and a production fluid outlet operable to selectively pass the production fluid to the tubing, the inflow control device configured to open or close the production fluid outlet based upon a pressure differential value (P3–P2).

C. A well system, the well system including: 1) a wellbore; 2) production tubing positioned within the wellbore; and 3) a fluid flow control system positioned between the wellbore and the production tubing, the fluid flow control system including; a) a fluid nozzle operable to receive production fluid having a pressure (P3) from the wellbore and discharge control fluid having a control pressure (P2); b) a fluid flow device operable to receive the control fluid having the control pressure (P2) and output a constant flow of control fluid to the production tubing, the fluid flow device including; i) a housing having at least one fluid inlet operable to receive the control fluid having the control pressure (P2) and at least one fluid outlet operable to output the constant flow of the control fluid to the production tubing; and ii) a flexible tube positioned within the housing, the flexible tube defining a fluid flow path, the flexible tube operable to have a first diameter when the flexible tube encounters a lower control pressure (P2) from the fluid nozzle and a second different diameter when the flexible tube encounters a second greater control pressure (P2) from the fluid nozzle, the first diameter and second different diameter configured to provide the constant flow of the control fluid to the production tubing; and c) an inflow control device having a production fluid inlet operable to receive the wellbore fluid having the pressure (P3), a control inlet operable to receive the fluid having the control pressure (P2) from the nozzle, and a production fluid outlet operable to pass the production fluid to the production tubing, the inflow control device configured to open or close the production fluid outlet based upon a pressure differential (P3–P2) value.

D. A fluid flow device, the fluid flow device including: 1) a housing having at least one fluid inlet and at least one fluid outlet; and 2) a sleeve positioned within the housing; and 3) a fluid flow member positioned within the sleeve, wherein the sleeve and fluid flow member are movable with respect to one another to define a first overlap distance and a first fluid flow path length when the housing encounters a first fluid flow pressure, and a second greater overlap distance and a second greater fluid flow path length when the housing encounters a second greater fluid flow pressure, the first fluid flow path length and the second greater fluid flow path length configured to provide a constant flow of the fluid out of the at least one fluid outlet.

E. A fluid flow control system, the fluid flow control system including: 1) a fluid nozzle operable to receive production fluid having a pressure (P3) and discharge control fluid having a control pressure (P2); 2) a fluid flow device operable to receive the control fluid having the control pressure (P2) and output a constant flow of control fluid to a tubing, the fluid flow device including; a) a housing having at least one fluid inlet operable to receive the control fluid having the control pressure (P2) and at least one fluid outlet operable to output the constant flow of the control fluid to the tubing; b) a sleeve positioned within the housing; and c) a fluid flow member positioned within the sleeve, wherein the sleeve and fluid flow member are movable with respect to one another to define a first overlap distance and a first fluid flow path length when the housing encounters a lower control pressure (P2), and a second greater overlap distance and a second greater fluid flow path length when the housing encounters a second greater control pressure (P2), the first fluid flow path length and the second greater fluid flow path length configured to provide a constant flow of the fluid out of the at least one fluid outlet; and 3) an inflow control device having a production fluid inlet operable to receive the wellbore fluid having the pressure (P3), a control inlet operable to receive the fluid having the control pressure (P2) from the nozzle, and a production fluid outlet operable to selectively pass the production fluid to the tubing, the inflow control device configured to open or close the production fluid outlet based upon a pressure differential value (P3–P2).

F. A well system, the well system including: 1) a wellbore; 2) production tubing positioned within the wellbore; and 3) a fluid flow control system positioned between the wellbore and the production tubing, the fluid flow control system including; a) a fluid nozzle operable to receive production fluid having a pressure (P3) and discharge control fluid having a control pressure (P2); b) a fluid flow device operable to receive the control fluid having the control pressure (P2) and output a constant flow of control fluid to the production tubing, the fluid flow device including; i) a housing having at least one fluid inlet operable to receive the control fluid having the control pressure (P2) and at least one fluid outlet operable to output the constant flow of the control fluid to the production tubing; ii) a sleeve positioned within the housing; and iii) a fluid flow member positioned within the sleeve, wherein the sleeve and fluid flow member are movable with respect to one another to define a first overlap distance h and a first fluid flow path length when the housing encounters a lower control pressure (P2), and a second greater overlap distance and a second greater fluid flow path length when the housing encounters a second greater control pressure (P2), the first fluid flow path length and the second greater fluid flow path length configured to provide a constant flow of the fluid out of the at least one fluid outlet; and c) an inflow control device having a production fluid inlet operable to receive the wellbore fluid having the pressure (P3), a control inlet operable to receive the fluid having the control pressure (P2) from the nozzle, and a production fluid outlet operable to selectively pass the production fluid to the production tubing, the inflow control device configured to open or close the production fluid outlet based upon a pressure differential value (P3–P2).

Aspects A, B, C, D, E and F may have one or more of the following additional elements in combination: Element 1: wherein an interior of the flexible tube provides the fluid flow path, and further wherein an annulus between the flexible tube and the housing is capped proximate an end of the tubing proximate the at least one fluid outlet, the flexible tube having the first diameter ($d_1$) when the annulus is subjected to the first pressure and a second lesser diameter ($d_2$) when the annulus is subjected to the second greater pressure. Element 2: wherein the flexible tube is operable to have a first length when it has the first diameter, and is operable to be radially compressed and have a second greater length when the flexible tube has the second lesser diameter. Element 3: further including a rigid member positioned within the flexible tube, the rigid member operable to prevent a collapse of the flexible tube when the annulus is subjected to the second greater pressure. Element 4: wherein the flexible tube is capped proximate the at least one fluid outlet, and further wherein an annulus between the capped flexible tube and the housing provides the fluid flow path, the flexible tube having the first diameter when an interior of the flexible tube is subjected to the first pressure from the fluid and a second greater diameter when the interior of the flexible tube is subjected to the second greater pressure from the fluid. Element 5: wherein the flexible tube is operable to have a first length when it has the first diameter, and is operable to be radially expanded and have a second lesser length when the flexible tube has the second greater diameter. Element 6: wherein the constant flow of the fluid is not affected by changes in a density of the fluid. Element 7: wherein the flow of the fluid out of the at least one fluid outlet remains constant when the first pressure and the second greater pressure remain within a range of 20 psi (137.895 kPa) to 200 psi (1378.95 kPa). Element 8: wherein the flexible tube and the housing are operable to create a laminar fluid flow path. Element 9: wherein an interior of the flexible tube provides the fluid flow path, and further wherein an annulus between the flexible tube and the housing is capped proximate an end of the tubing proximate the at least one fluid outlet, the flexible tube having the first diameter when the annulus is subjected to the first pressure and a second lesser diameter when the annulus is subjected to the second greater pressure. Element 10: wherein the flexible tube is operable to have a first length when it has the first diameter, and is operable to be radially compressed and have a second greater length when the flexible tube has the second lesser diameter. Element 11: further including a rigid member positioned within the flexible tube, the rigid member operable to prevent a collapse of the flexible tube when the annulus is subjected to the second greater pressure. Element 12: wherein the flexible tube is capped proximate the at least one fluid outlet, and further wherein an annulus between the capped flexible tube and the housing provides the fluid flow path, the flexible tube having the first diameter when an interior of the flexible tube is subjected to the first pressure from the fluid and a second greater diameter when the interior of the flexible tube is subjected to the second greater pressure from the fluid. Element 13: wherein the flexible tube is operable to have a first length when it has the first diameter, and is operable to be radially expanded and have a second lesser length when the flexible tube has the second greater diameter. Element 14: wherein the constant flow of the control fluid is not affected by changes in a density of the fluid. Element 15: wherein the flow of the control fluid to the tubing remains constant when the first pressure and the second greater pressure remain within a range of 20 psi (137.895 kPa) to 200 psi (1378.95 kPa). Element 16: wherein the flexible tube and the housing are operable to create a laminar fluid flow path. Element 17: wherein: an interior of the flexible tube provides the fluid flow path, and further wherein an annulus between the flexible tube and the housing is capped proximate an end of the tubing proximate the at least one fluid outlet, the flexible tube having the first diameter when the annulus is subjected to the first pressure and a second lesser diameter when the annulus is subjected to the second greater pressure; or the flexible tube is capped proximate the at least one fluid outlet, and further wherein an annulus between the capped flexible tube and the housing provides the fluid flow path, the flexible tube having the first diameter when an interior of the flexible tube is subjected to the first pressure from the fluid and a second greater diameter when the interior of the flexible tube is subjected to the second greater pressure from the fluid. Element 18: wherein at least one of an interior surface of the sleeve or an exterior surface of the fluid flow member having a non-linear fluid flow path therein, wherein the sleeve and fluid flow member are movable with respect to one another to define a first overlap distance of the non-linear fluid flow path and a first fluid flow path length when the housing encounters a first fluid flow pressure, and a second greater overlap distance of the non-linear fluid flow path and a second greater fluid flow path length when the housing encounters a second greater fluid flow pressure. Element 19: wherein the fluid flow member is fixed relative to the housing and the sleeve is movable with respect to the housing and the fluid flow member. Element 20: wherein the fluid flow member is a piston, and further including a spring member positioned between the piston and the movable sleeve. Element 21: wherein the sleeve is fixed relative to the housing and the fluid flow member is movable with respect to the housing and the sleeve. Element 22: wherein the exterior surface of the fluid flow member includes the non-linear fluid flow path therein. Element 23: wherein the non-linear fluid flow path in the exterior surface of the fluid flow member is a helical fluid flow path. Element 24: wherein the interior surface of the sleeve includes the non-linear fluid flow path therein. Element 25: wherein the non-linear fluid flow path in the interior surface of the sleeve is a helical fluid flow path. Element 26: wherein the fluid flow member is a piston fixed relative to the housing and the sleeve is movable with respect to the housing and the piston, and further wherein the non-linear fluid flow path is a helical fluid flow path located in the exterior surface of the piston. Element 27: wherein at least one of an interior surface of the sleeve or an exterior surface of the fluid flow member having a non-linear fluid flow path therein, wherein the sleeve and fluid flow member are movable with respect to one another to define a first overlap distance of the non-linear fluid flow path and a first fluid flow path length when the housing encounters a first fluid flow pressure, and a second greater overlap distance of the non-linear fluid flow path and a second greater fluid flow path length when the housing encounters a second greater fluid flow pressure. Element 28: wherein the fluid flow member is fixed relative to the housing and the sleeve is movable with respect to the housing and the fluid flow member. Element 29: wherein the fluid flow member is a piston, and further including a spring member positioned between the piston and the movable sleeve. Element 30: wherein the sleeve is fixed relative to the housing and the fluid flow member is movable with respect to the housing and the sleeve. Element 31: wherein the exterior surface of the fluid flow member includes the non-linear fluid flow path therein. Element 32: wherein the non-linear fluid flow path in the exterior surface of the fluid flow member is a helical fluid flow path. Element 33: wherein the interior surface of the sleeve includes the non-linear fluid flow path therein. Element 34: wherein the non-linear fluid flow path in the interior surface of the sleeve is a helical fluid flow path. Element 35: wherein the fluid flow member is a piston fixed relative to the housing and the sleeve is movable with respect to the housing and the piston, and further wherein the non-linear fluid flow path is a helical fluid flow path located in the exterior surface of the piston. Element 36: wherein at least one of an interior surface of the sleeve or an exterior surface of the fluid flow member having a non-linear fluid flow path therein, wherein the sleeve and fluid flow member are movable with respect to one another to define a first overlap distance of the non-linear fluid flow path and a first fluid flow path length when the housing encounters a first fluid flow pressure, and a second greater overlap distance of the non-linear fluid flow path and a second greater fluid flow path length when the housing encounters a second greater fluid flow pressure. Element 37: wherein the fluid flow member is a piston fixed relative to the housing and the sleeve is movable with respect to the housing and the piston, and further wherein the non-linear fluid flow path is a helical fluid flow path located in the exterior surface of the piston.

Those skilled in the art to which this application relates will appreciate that other and further additions, deletions, substitutions, and modifications may be made to the described embodiments.

What is claimed is:

1. A fluid flow device, comprising:

a housing having at least one fluid inlet and at least one fluid outlet; and a flexible tube positioned within the housing, the flexible tube defining a fluid flow path, the flexible tube operable to have a first diameter ($d_1$) when the flexible tube encounters a first pressure from fluid within the housing and a second different diameter ($d_2$) when the flexible tube encounters a second greater pressure within the housing, the first diameter ($d_1$) and the second different diameter ($d_2$) configured to provide a constant flow of the fluid out of the at least one fluid outlet, wherein an interior of the flexible tube provides the fluid flow path, and further wherein an annulus between the flexible tube and the housing is capped proximate an end of the flexible tube proximate the at least one fluid outlet, the flexible tube having the first diameter ($d_1$) when the annulus is subjected to the first pressure and a second lesser diameter ($d_2$) when the annulus is subjected to the second greater pressure, and further including a rigid member positioned within the flexible tube, the rigid member operable to prevent a collapse of the flexible tube when the annulus is subjected to the second greater pressure.

2. The fluid flow device according to claim 1, wherein the flexible tube is operable to have a first length when the flexible tube has the first diameter, and is operable to be radially compressed and have a second greater length when the flexible tube has the second lesser diameter.

3. The fluid flow device according to claim 1, wherein the constant flow of the fluid is not affected by changes in a density of the fluid.

4. The fluid flow device according to claim 1, wherein the flexible tube and the housing are operable to create a laminar fluid flow path.

5. The fluid flow device according to claim 1, wherein the flow of the fluid out of the at least one fluid outlet remains constant when the first pressure and the second greater pressure remain within a range of 137.895 kPa to 1378.95 kPa.

6. A fluid flow device, comprising:

a housing having at least one fluid inlet and at least one fluid outlet; and a flexible tube positioned within the housing, the flexible tube defining a fluid flow path, the flexible tube operable to have a first diameter ($d_1$) when the flexible tube encounters a first pressure from fluid within the housing and a second different diameter ($d_2$) when the flexible tube encounters a second greater pressure within the housing, the first diameter ($d_1$) and second different diameter ($d_2$) configured to provide a constant flow of the fluid out of the at least one fluid outlet, wherein the flexible tube is capped proximate the at least one fluid outlet, and further wherein an annulus between the capped flexible tube and the housing provides the fluid flow path, the flexible tube having the first diameter when an interior of the flexible tube is subjected to the first pressure from the fluid and a second greater diameter when the interior of the flexible tube is subjected to the second greater pressure from the fluid.

7. The fluid flow device according to claim 6, wherein the flexible tube is operable to have a first length when the flexible tube has the first diameter, and is operable to be radially expanded and have a second lesser length when the flexible tube has the second greater diameter.

8. A fluid flow control system, comprising:

a fluid nozzle operable to receive production fluid having a pressure (P3) and discharge control fluid having a control pressure (P2);

a fluid flow device operable to receive the control fluid having the control pressure (P2) and output a constant flow of control fluid to a tubing, the fluid flow device including;

a housing having at least one fluid inlet operable to receive the control fluid having the control pressure (P2) and at least one fluid outlet operable to output the constant flow of the control fluid to the tubing; and a flexible tube positioned within the housing, the flexible tube defining a fluid flow path, the flexible tube operable to have a first diameter when the flexible tube encounters a lower control pressure (P2) from the fluid nozzle and a second different diameter when the flexible tube encounters a second greater control pressure (P2) from the fluid nozzle, the first diameter and the second different diameter configured to provide the constant flow of the control fluid to the tubing;

an inflow control device having a production fluid inlet operable to receive the production fluid having the pressure (P3), a control inlet operable to receive the fluid having the control pressure (P2) from the nozzle, and a production fluid outlet operable to selectively pass the production fluid to the tubing, the inflow control device configured to open or close the production fluid outlet based upon a pressure differential value (P3–P2).

9. The fluid flow control system according to claim 8, wherein an interior of the flexible tube provides the fluid flow path, and further wherein an annulus between the flexible tube and the housing is capped proximate an end of the flexible tube proximate the at least one fluid outlet, the flexible tube having the first diameter when the annulus is subjected to the first pressure and a second lesser diameter when the annulus is subjected to the second greater pressure.

10. The fluid flow control system according to claim 9, wherein the flexible tube is operable to have a first length when the flexible tube has the first diameter, and is operable to be radially compressed and have a second greater length when the flexible tube has the second lesser diameter.

11. The fluid flow control system according to claim 9, further including a rigid member positioned within the flexible tube, the rigid member operable to prevent a collapse of the flexible tube when the annulus is subjected to the second greater pressure.

12. The fluid flow control system according to claim 8, wherein the flexible tube is capped proximate the at least one fluid outlet, and further wherein an annulus between the capped flexible tube and the housing provides the fluid flow path, the flexible tube having the first diameter when an interior of the flexible tube is subjected to the first pressure from the fluid and a second greater diameter when the interior of the flexible tube is subjected to the second greater pressure from the fluid.

13. The fluid flow control system according to claim 12, wherein the flexible tube is operable to have a first length when the flexible tube has the first diameter, and is operable to be radially expanded and have a second lesser length when the flexible tube has the second greater diameter.

14. The fluid flow control system according to claim 8, wherein the constant flow of the control fluid is not affected by changes in a density of the fluid.

15. The fluid flow control system according to claim 8, wherein the flow of the control fluid to the tubing remains constant when the first pressure and the second greater pressure remain within a range of 137.895 kPa to 1378.95 kPa.

16. The fluid flow control system according to claim 8, wherein the flexible tube and the housing are operable to create a laminar fluid flow path.

17. A well system, comprising:

a wellbore;

production tubing positioned within the wellbore; and a fluid flow control system positioned between the wellbore and the production tubing, the fluid flow control system including;

a fluid nozzle operable to receive production fluid having a pressure (P3) from the wellbore and discharge control fluid having a control pressure (P2);

a fluid flow device operable to receive the control fluid having the control pressure (P2) and output a constant flow of control fluid to the production tubing, the fluid flow device including;

a housing having at least one fluid inlet operable to receive the control fluid having the control pressure (P2) and at least one fluid outlet operable to output the constant flow of the control fluid to the production tubing; and a flexible tube positioned within the housing, the flexible tube defining a fluid flow path, the flexible tube operable to have a first diameter when the flexible tube encounters a lower control pressure (P2) from the fluid nozzle and a second different diameter when the flexible tube encounters a second greater control pressure (P2) from the fluid nozzle, the first diameter and the second different diameter configured to provide the constant flow of the control fluid to the production tubing; and an inflow control device having a production fluid inlet operable to receive the wellbore fluid having the pressure (P3), a control inlet operable to receive the fluid having the control pressure (P2) from the nozzle, and a production fluid outlet operable to pass the production fluid to the production tubing, the inflow control device configured to open or close the production fluid outlet based upon a pressure differential (P3−P2) value.

18. The well system according to claim 17, wherein:

an interior of the flexible tube provides the fluid flow path, and further wherein an annulus between the flexible tube and the housing is capped proximate an end of the flexible tube proximate the at least one fluid outlet, the flexible tube having the first diameter when the annulus is subjected to the first pressure and a second lesser diameter when the annulus is subjected to the second greater pressure; or the flexible tube is capped proximate the at least one fluid outlet, and further wherein an annulus between the capped flexible tube and the housing provides the fluid flow path, the flexible tube having the first diameter when an interior of the flexible tube is subjected to the first pressure from the fluid and a second greater diameter when the interior of the flexible tube is subjected to the second greater pressure from the fluid.

* * * * *